US010008145B2

(12) United States Patent
Albrecht et al.

(10) Patent No.: US 10,008,145 B2
(45) Date of Patent: *Jun. 26, 2018

(54) REFRESH RATE DEPENDENT DITHERING

(71) Applicant: Apple Inc., Cupertino, CA (US)

(72) Inventors: Marc Albrecht, San Francisco, CA (US); Christopher P. Tann, San Jose, CA (US)

(73) Assignee: Apple Inc., Cupertino, CA (US)

( * ) Notice: Subject to any disclaimer, the term of this patent is extended or adjusted under 35 U.S.C. 154(b) by 92 days.

This patent is subject to a terminal disclaimer.

(21) Appl. No.: 15/203,654

(22) Filed: Jul. 6, 2016

(65) Prior Publication Data

US 2016/0314734 A1 Oct. 27, 2016

Related U.S. Application Data

(63) Continuation of application No. 14/319,963, filed on Jun. 30, 2014, now Pat. No. 9,390,690.

(51) Int. Cl.
*G09G 3/20* (2006.01)
*G09G 5/393* (2006.01)

(52) U.S. Cl.
CPC ..... *G09G 3/2055* (2013.01); *G09G 3/2003* (2013.01); *G09G 3/2051* (2013.01); *G09G 3/2066* (2013.01); *G09G 5/393* (2013.01); *G09G 2310/08* (2013.01); *G09G 2320/0247* (2013.01); *G09G 2320/0266* (2013.01); *G09G 2330/021* (2013.01); *G09G 2330/022* (2013.01); *G09G 2340/0435* (2013.01)

(58) Field of Classification Search
None
See application file for complete search history.

(56) References Cited

U.S. PATENT DOCUMENTS 8,553,881 B2 10/2013 Lee et al.
2004/0223063 A1* 11/2004 DeLuca ..... G06K 9/0061 348/239
2006/0268180 A1* 11/2006 Chou ..... G06T 5/009 348/673

(Continued)

FOREIGN PATENT DOCUMENTS

EP 656616 A1 6/1995

*Primary Examiner* — Ryan D McCulley
(74) *Attorney, Agent, or Firm* — Fletcher Yoder PC

(57) ABSTRACT

Systems and methods are provided to perform refresh-rate dependent dithering. One embodiment describes a computing device that includes an image source that generates spatially dithered image data and an electronic display communicatively coupled to the image source. More specifically, the electronic display receives the spatially dithered image data from the image source and determines a refresh rate with which to display an image by comparing a local histogram and an artifact histogram, in which the local histogram describes pixel grayscale distribution of a portion of the image and the artifact histogram describes a pixel grayscale distribution that when displayed will cause a perceivable artifact. Additionally, when the determined refresh rate is less than a threshold refresh rate of the electronic device, the electronic display spatially dithers the image data without temporally dithering the image data and displays the image based at least in part on the spatially dithered image data.

20 Claims, 12 Drawing Sheets

(56) References Cited

U.S. PATENT DOCUMENTS

| | | | | |
|---|---|---|---|---|
| 2007/0258014 | A1* | 11/2007 | Doswald | H04N 7/0115 348/701 |
| 2008/0129732 | A1* | 6/2008 | Johnson | G06T 7/0002 345/424 |
| 2010/0080459 | A1 | 4/2010 | Dai et al. | |
| 2012/0236021 | A1 | 9/2012 | Parmar et al. | |
| 2014/0218418 | A1 | 8/2014 | Bastani et al. | |
| 2015/0109355 | A1 | 4/2015 | Wang et al. | |
| 2015/0287355 | A1 | 10/2015 | Cho et al. | |
| 2015/0339994 | A1 | 11/2015 | Verbeure | |
| 2016/0078798 | A1* | 3/2016 | Watanabe | G09G 3/2007 345/690 |
| 2016/0086557 | A1* | 3/2016 | Watanabe | G09G 3/3648 345/691 |
| 2016/0093239 | A1* | 3/2016 | Wang | G06F 1/32 345/55 |

* cited by examiner

REFRESH RATE DEPENDENT DITHERING

CROSS-REFERENCE TO RELATED APPLICATIONS

Under 35 U.S.C. § 120, this application is a continuation of U.S. patent application Ser. No. 14/319,963 filed on Jun. 30, 2014, which is incorporated by reference herein in its entirety for all purposes.

BACKGROUND

The present disclosure relates generally to an electronic display, and more particularly, to dithering based at least in part on a refresh rate used by the electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Generally, an electronic display may display a visual representation of images. In some embodiments, the properties with which images are displayed may affect the quality of the displayed image and/or operational properties of the electronic display. For example, adjusting the refresh rate of an electronic device may affect the power consumption by the electronic display. More specifically, when the refresh rate is higher, the power consumption may also be higher. On the other hand, when the refresh rate is lower, the power consumption may also be lower. However, when the refresh rate is lower, the quality of the displayed image may be affected, for example, by increasing the possibility of flickering and/or artifacts distorting the displayed image.

Accordingly, it would be beneficial to improve displayed image quality even when the electronic display utilizes a lower refresh rate, for example, by reducing the possibility that flickering and/or artifacts distort the image.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to improving quality of images displayed on an electronic display. In some embodiments, the refresh rate of the electronic display may be adjustable to adjust power consumption by the electronic display.

Accordingly, in some embodiments, image dither may vary depending on a refresh rate to avoid flickering and/or artifacts that might otherwise occur at low refresh rates. Namely, when the refresh rate is reduced below the threshold refresh rate, a temporal dithering component may be stopped to reduce the possibility of flickering in the displayed image. For example, a timing controller (TCON) in the electronic device may switch off the temporal portion of a spatio-temporal dithering component or switch to a separate spatial dithering component. In other words, the timing controller may employ spatial dithering without any temporal dithering to reduce the possibility of flickering.

Additionally, in some embodiments, an image may be analyzed for risk of artifacts before displaying the image at a refresh rate below the threshold refresh rate. For example, portions of the image may be analyzed successively by generating local histograms and comparing them with artifact histograms. More specifically, a local histogram may be generated for a portion (e.g., window) of the image to describe the number of pixels in the portion of the image at different grayscales displayable by the electronic display. The local histogram may then be compared with one or more artifact histograms, which describe pixel grayscale distributions that are likely to cause an artifact. In other words, based on the amount of overlap between the local histogram and the one or more artifact histograms, the risk of an artifact being displayed in that portion of the image may be determined. As such, the risk of artifacts may be determined for different portions of the image as well as for each color (e.g., red, green, and blue) used by the electronic display to produce the image.

BRIEF DESCRIPTION OF THE DRAWINGS

Various aspects of this disclosure may be better understood upon reading the following detailed description and upon reference to the drawings in which.

DETAILED DESCRIPTION

Figure 1:
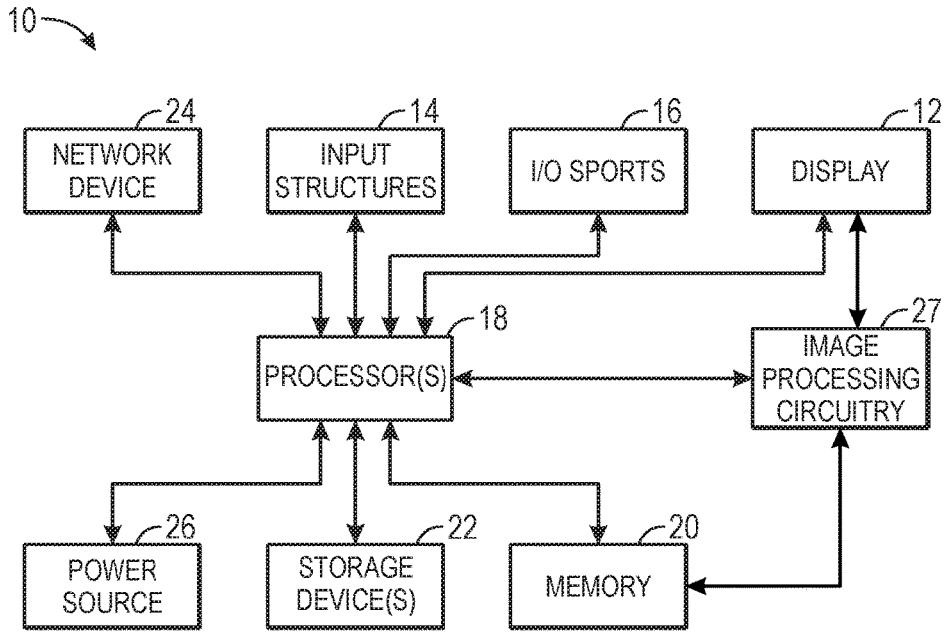
FIG. 1 is a block diagram of a computing device used to display images, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, the refresh rate of an electronic display may be adjustable. As used herein, "refresh rate" is intended to describe the number of times that an electronic display writes an image or frame of video to the screen. Accordingly, in some embodiments, reducing the refresh rate may lower the power consumption by the electronic display because the electronic display writes an image less often.

However, as the refresh rate is reduced, the quality of an image may suffer. More specifically, an image viewed on an electronic display may in fact be made up of a number of images successively displayed. In other words, to view the image, a viewer's eyes may average together the successively displayed images. Accordingly, in some embodiments, taking advantage of this fact, the successively displayed images may have slight variations. Thus, when the refresh rate is high enough, the variations may be unperceivable to the viewer and the viewer's eyes may average in the variations. However, as the refresh rate is reduced, the variations between the successively displayed images may become more noticeable. In fact, in some embodiments, the variations may otherwise cause flickering to be perceived in the displayed image.

Accordingly, one embodiment of the present disclosure describes an electronic display that determines when a desired refresh rate of the electronic display is below a threshold refresh rate. As used herein, a "threshold refresh rate" is intended to describe a refresh rate at or below which flickering and/or artifacts may noticeably distort a displayed image. As will be described in more detail below, the threshold refresh rate may vary depending properties of the electronic display, such as the type of display and the resolution of the display, and/or the particular person viewing the electronic display. More specifically, when the desired refresh rate is below the threshold refresh rate, the electronic display may disable a temporal dithering component, which may reduce the possibility of flickering. In some embodiments, as will be described in more detail below, the temporal dithering component may be disabled by disabling a temporal portion of a spatio-temporal dithering component or switching to an error-diffusion (e.g., spatial) dithering component. In some embodiments, when the temporal dithering component is disabled, the electronic display may display images using only spatial dithering.

In fact, in some embodiments, an image may be spatially dithered by an image source (e.g., graphics card or application) and again spatially dithered by the electronic display. More specifically, the image source may also perform a spatial dithering because different spatial dithering algorithms may be implemented by the source as compared to the electronic display. However, when two spatial dithering components are used on an image, artifacts may distort the image. For example, in some embodiments, an artifact may otherwise occur and cause portions of the image to be perceived inaccurately, for example, in the wrong color.

Accordingly, one embodiment of the present disclosure describes an electronic display that, when the temporal component is disabled, determines whether a portion of the image is at risk of being displayed with an artifact by comparing a local histogram with an artifact histogram. More specifically, the local histogram may describe the number of pixels in the portion of the image at different grayscale levels displayable by the display device and the artifact histogram may describe the distribution of pixels across the grayscale levels that will cause an artifact to be displayed. As such, in some embodiments, the amount of overlap between the local histogram and the artifact histogram may predict the likelihood that an artifact will distort the image.

Thus, based on the comparison, the refresh rate with which to display the image may also be determined. More specifically, in some embodiments, an image may first be displayed at a refresh rate above the threshold refresh rate and if it is determined that the image can be displayed below the threshold refresh rate with little risk of artifacts, the refresh rate may be reduced accordingly. In other embodiments, before the image is displayed, it may be determined whether the image may be displayed at a desired refresh rate below the threshold refresh rate with little risk of artifacts and if it can, the image may be displayed at the desired refresh rate. On the other hand, if the image is at risk for being displayed with artifacts, the image may be displayed at a refresh rate above the threshold refresh rate.

In other words, as will be described in more detail below, the techniques described herein may enable images to be displayed at varying refresh rates, even below the threshold refresh rate, while reducing the risk of the image being distorted, for example, by flickering or artifacts. To help illustrate, a computing device 10 that utilizes an electronic display 12 to display images is described in FIG. 1. As will be described in more detail below, the computing device 10 may be any suitable computing device, such as a handheld computing device, a tablet computing device, a notebook computer, and the like.

Accordingly, as depicted, the computing device 10 includes the display 12, input structures 14, input/output (I/O) ports 16, one or more processor(s) 18, memory 20, nonvolatile storage 22, a network interface 24, and a power source 26, and image processing circuitry 27. The various components described in FIG. 1 may include hardware elements (including circuitry), software elements (including computer code stored on a non-transitory computer-readable medium), or a combination of both hardware and software elements. It should be noted that FIG. 1 is merely one example of a particular implementation and is intended to illustrate the types of components that may be present in the computing device 10. Additionally, it should be noted that the various depicted components may be combined into fewer components or separated into additional components. For example, the image processing circuitry 27 (e.g., graphics processing unit) may be included in the one or more processors 18.

As depicted, the processor 18 and/or image processing circuitry 27 are operably coupled with memory 20 and/or nonvolatile storage device 22. More specifically, the processor 18 and/or image processing circuitry 27 may execute instruction stored in memory 20 and/or non-volatile storage device 22 to perform operations in the computing device 10, such as dithering an image. As such, the processor 18 and/or image processing circuitry 27 may include one or more general purpose microprocessors, one or more application specific processors (ASICs), one or more field programmable logic arrays (FPGAs), or any combination thereof. Additionally, memory 20 and/or non volatile storage device 22 may be a tangible, non-transitory, computer-readable medium that stores instructions executable by and data to be processed by the processor 18 and/or image processing circuitry 27. In other words, the memory 20 may include random access memory (RAM) and the non-volatile storage device 22 may include read only memory (ROM), rewritable flash memory, hard drives, optical discs, and the like. By way of example, a computer program product containing the instructions may include an operating system (e.g., OS X® or iOS by Apple Inc.) or an application program (e.g., iBooks® by Apple Inc.).

Additionally, as depicted, the processor 18 is operably coupled with the network interface 24 to communicatively couple the computing device 10 to a network. For example, the network interface 24 may connect the computing device 10 to a personal area network (PAN), such as a Bluetooth network, a local area network (LAN), such as an 802.11x Wi-Fi network, and/or a wide area network (WAN), such as a 4G or LTE cellular network. Furthermore, as depicted, the processor 18 is operably coupled to the power source 26, which provides power to the various components in the computing device 10. As such, the power source 26 may includes any suitable source of energy, such as a rechargeable lithium polymer (Li-poly) battery and/or an alternating current (AC) power converter.

As depicted, the processor 18 is also operably coupled with I/O ports 16, which may enable the computing device 10 to interface with various other electronic devices, and input structures 14, which may enable a user to interact with the computing device 10. Accordingly, the inputs structures 14 may include buttons, keyboards, mice, trackpads, and the like. Additionally, in some embodiments, the display 12 may include touch sensitive components. For example, the electronic display 12 may be a MultiTouch™ display that can detect multiple touches at once.

In addition to enabling user inputs, the display 12 may display images. In some embodiments, the images displayed may be a graphical user interface (GUI) for an operating system, an application interface, a still image, or a video. As depicted, the display is operably coupled to the processor 18 and the image processing circuitry 27. Accordingly, the images displayed by the display 12 may be based on image data received from the processor 18 and/or the image processing circuitry 27.

More specifically, the processor 18 and/or the image processing circuitry 27 may generate and process image data to create a digital representation of the image to be displayed. In other words, the image data is generated such that the image view on the display 12 accurately represents the intended image. To facilitate generating image data that accurately represents the image, the processor 18 and/or image processing circuitry 27 may perform various image processing steps, such as spatial dithering, temporal dithering, pixel color-space conversion, luminance determination, luminance optimization, image scaling operations, and the like. For example, in some embodiments, the image data may be spatially dithered by adding color noise so that the viewed image includes less banding and less flat areas.

As will be described in more detail below, once the display 12 receives the image data, additional processing may be performed on the image data to further improve the accuracy of the viewed image. For example, the display 12 may again spatially dither the image data. Additionally or alternatively, the display may temporally dither the image data by modifying pixels in successively displayed images so that the user's eye will blend together the pixels from the successive images and view an intermediate color. For example, a pixel in a first image may be blue and a corresponding pixel in the second image may be red. Thus, when the two images are rapidly displayed successively, a viewer's eye may see a purple pixel.

Figure 2:
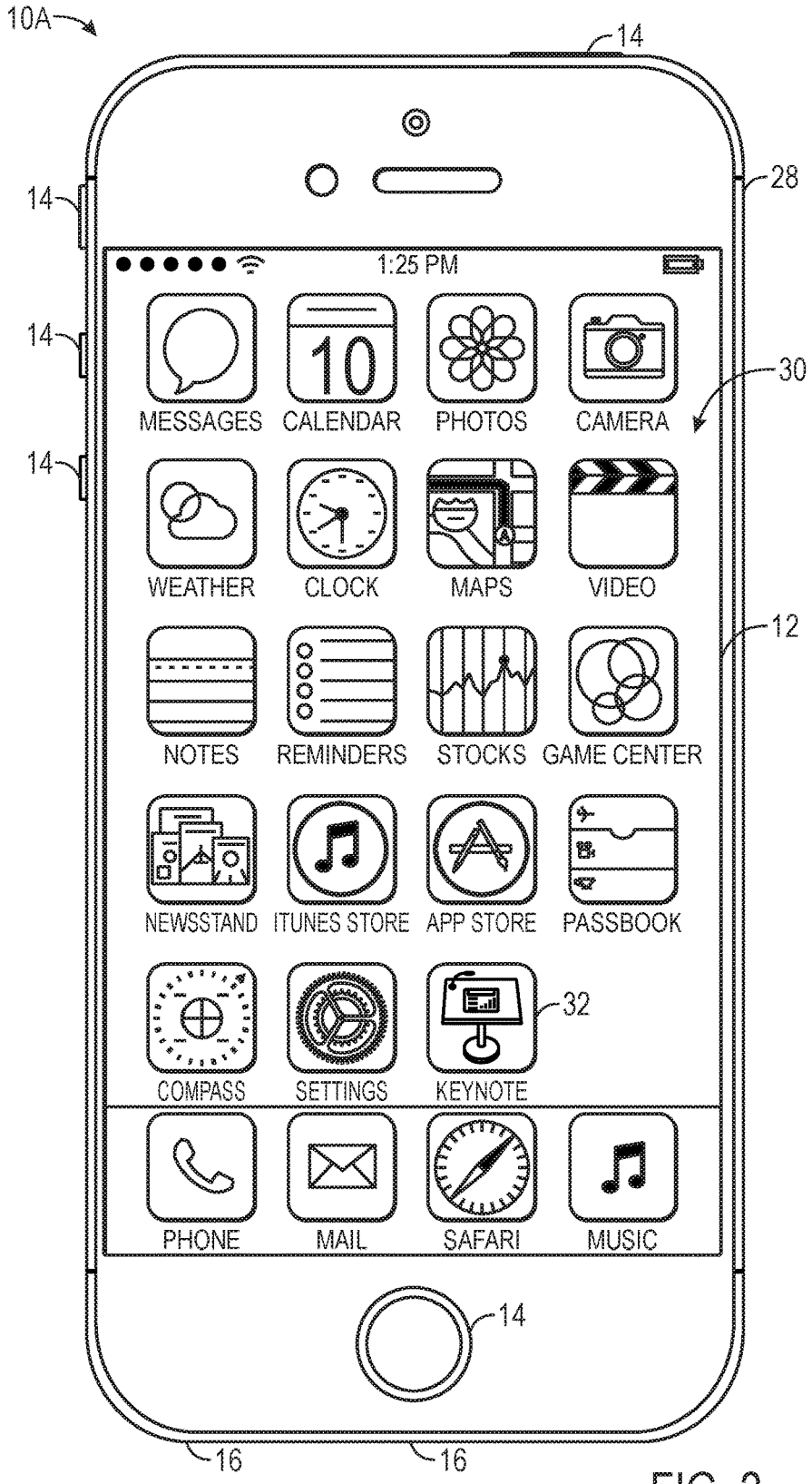
FIG. 2 is an example of the computing device of FIG. 1, in accordance with an embodiment.

As described above, the computing device 10 may be any suitable electronic device. To help illustrate, one example of a handheld device 10A is described in FIG. 2, which may be a portable phone, a media player, a personal data organizer, a handheld game platform, or any combination of such devices. Accordingly, by way of example, the handheld device 10A may be a model of an iPod® or iPhone® available from Apple Inc. of Cupertino, Calif.

As depicted, the handheld device 10A includes an enclosure 28, which may protect interior components from physical damage and to shield them from electromagnetic interference. The enclosure 28 may surround the display 12, which, in the depicted embodiment, displays a graphical user interface (GUI) 30 having an array of icons 32. By way of example, when an icon 32 is selected either by an input structure 14 or a touch sensing component of the display, an application program, such as iBooks® made by Apple Inc., may launch.

Additionally, as depicted, input structure 14 may open through the enclosure 28. As described above, the input structures 14 may enable a user to interact with the handheld device 10A. For example, the input structures 14 may activate or deactivate the handheld device 10A, navigate a user interface to a home screen, navigate a user interface to a user-configurable application screen, activate a voice-recognition feature, provide volume control, and toggle between vibrate and ring modes. Furthermore, as depicted, the I/O ports 16 open through the enclosure 28. In some embodiments, the I/O ports 16 may include, for example, an audio jack and/or a Lightning® port from Apple Inc. to connect to external devices.

Figure 3:
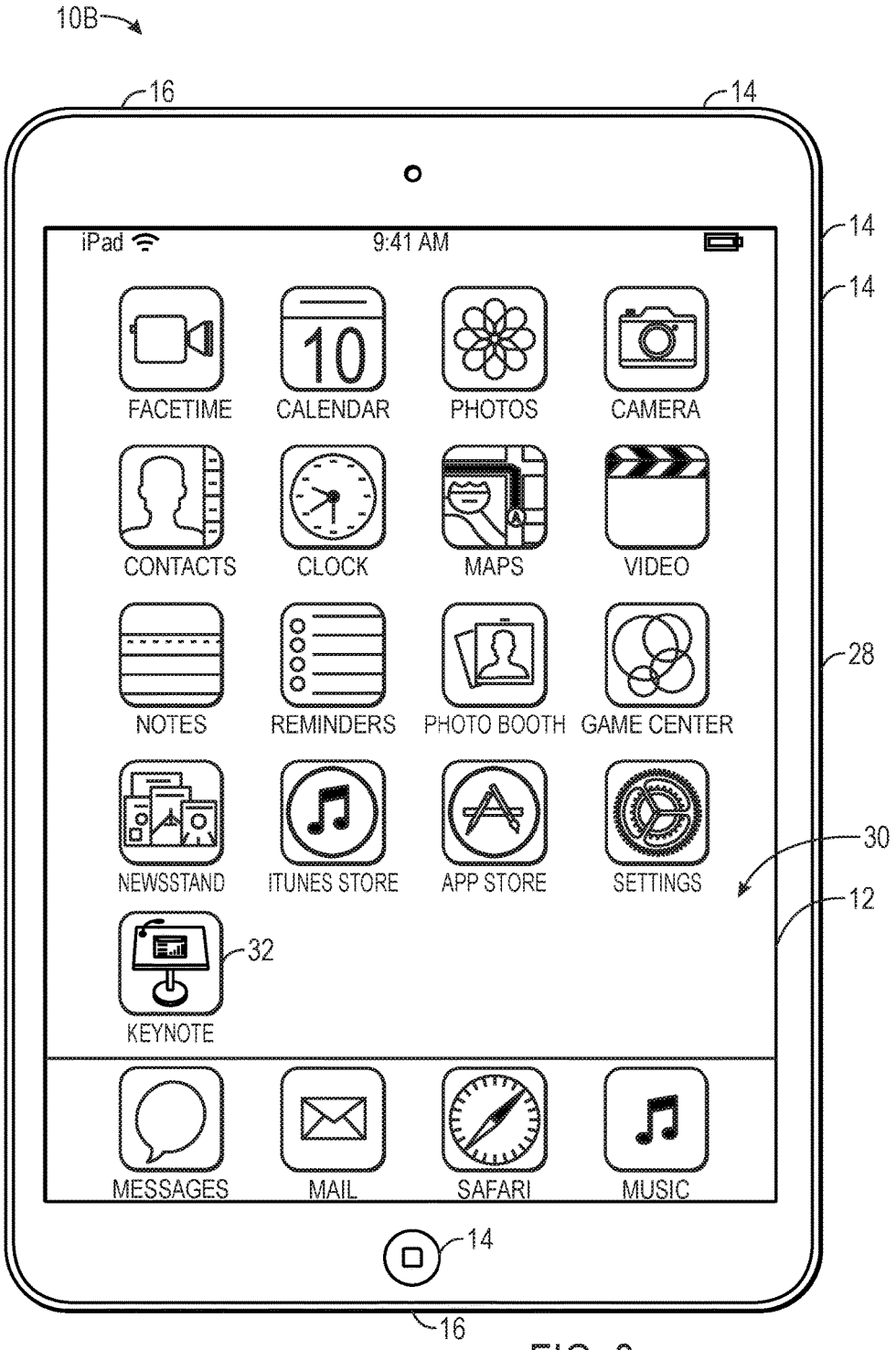
FIG. 3 is an example of the computing device of FIG. 1, in accordance with an embodiment.
Figure 4:
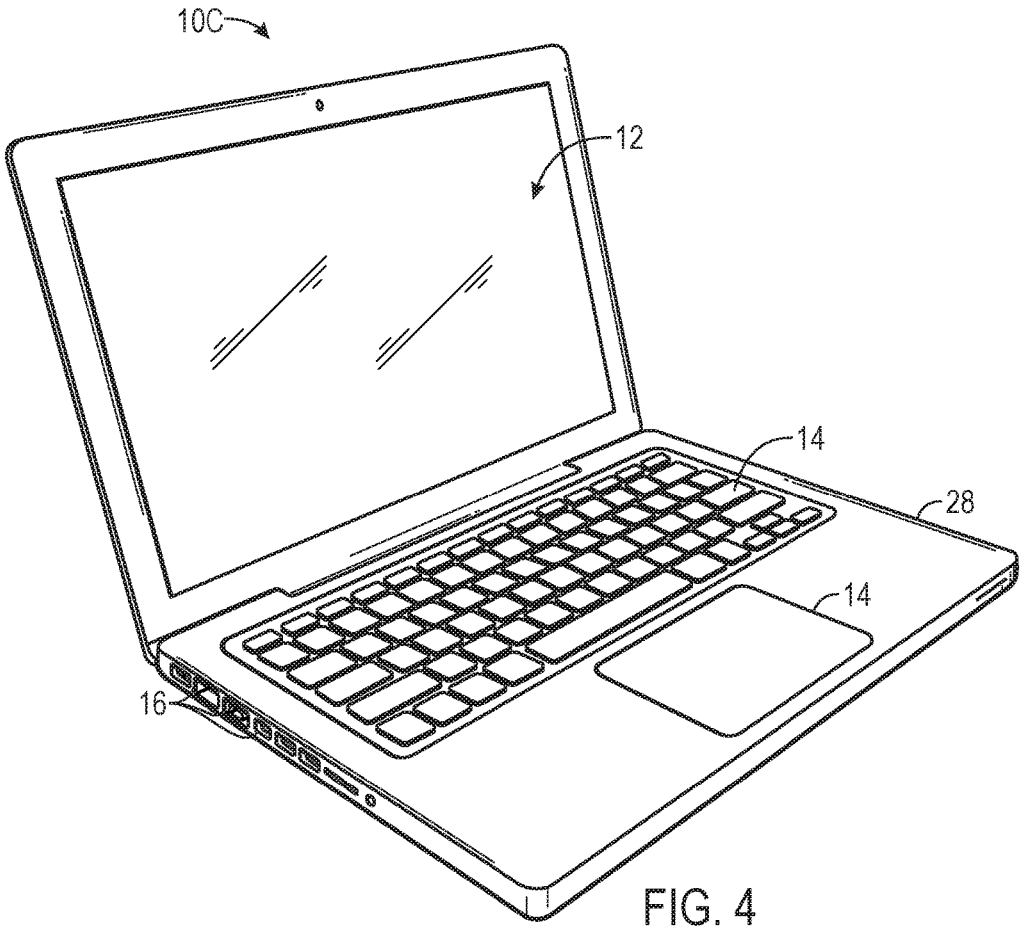
FIG. 4 is an example of the computing device of FIG. 1, in accordance with an embodiment.

To further illustrate a suitable computing device 10, a tablet device 10B is described in FIG. 3. By way of example, the tablet device 10B may be a model of an iPad® available from Apple Inc. Additionally, in other embodiments, the computing device 10 may take the form of a computer 10C as described in FIG. 4. By way of example, the computer 10C may be a model of a MacBook®, MacBook® Pro, MacBook Air®, iMac®, Mac® mini, or Mac Pro® available from Apple Inc. As depicted, the computer 10C also includes a display 12, input structures 14, I/O ports 16, and a housing 28.

Figure 5:
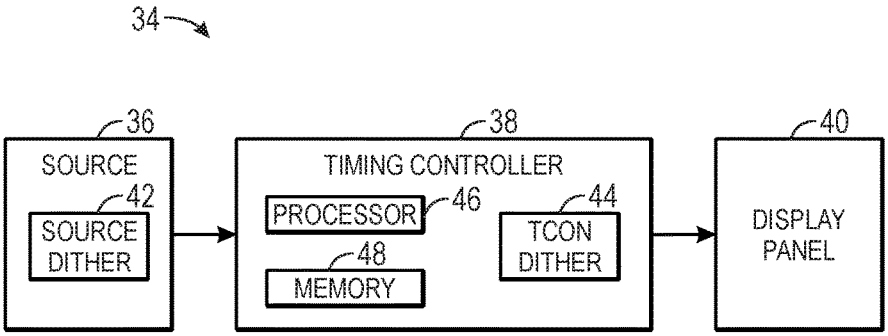
FIG. 5 is block diagram of a portion of the computing device of FIG. 1 used to display images, in accordance with an embodiment.

As described above, the display 12 may display images based on image data received from the processor 18 and/or the image processing circuitry 27. More specifically, the image data may be processed by any combination of the processor 18, the image processing circuitry 27, and the display 12 itself. To help illustrate, a portion 34 of the computing device 10 that processes and communicates image data is described in FIG. 5.

As depicted, the portion 34 of the computing device 10 includes a source 36, a timing controller (TCON) 38, and a display panel 40. More specifically, the source 36 may generate the image data. Accordingly, in some embodiments, the source 36 may be the processor 18 and/or the image processing circuitry 27. As described above, the processor 18 and/or the image processing circuitry 27 may processes image data so that an image is accurately viewed. Thus, as depicted, the source 36 includes a source dithering component 42. In some embodiments, the source dithering component 42 may spatially dither the image data by adding color noise into the image data.

As described above, the image data generated and processed by the source 36 may then be transmitted to the display 12. In some embodiments, the timing controller 38 and the display panel 40 may be included in the display 12. More specifically, the timing controller 38 may receive the image data from the source 36 and perform additional processing to further improve accuracy of the viewed image. For example, the timing controller 38 may perform additional dithering on the image data received. Accordingly, as depicted, the timing controller 38 includes a TCON dithering component 44. In some embodiments, the TCON dithering component 44 may perform spatial dithering, temporal dithering, spatio-temporal dithering, error-diffusion dithering, or the like.

To facilitate processing the image data, the timing controller 38 may include a timing controller processor 46 and memory 48. In some embodiments, the timing controller processor 46 may be included in the processor 18 and/or the image processing circuitry 27. In other embodiments, the timing controller processor 18 may be a separate processing module in the display 12. Additionally, in some embodiments, the timing controller memory 48 may be part of memory 20. In other embodiments, the timing controller memory 48 may be a separate memory module in the display 12. However, in any embodiment, the timing controller memory 48 may be a tangible, non-transitory, computer-readable medium that stores instructions executable by the timing controller processor 46, for example, to perform dithering on the image data.

The processed image data may then be transmitted from the timing controller 38 to the display panel 40 for display. More specifically, the display panel 40 may display images by setting each pixel grayscale value according to the image data. For example, when the image data is in an 8-bit format, the image data may instruct the display panel 40 to set a red pixel at [0, 0] to a grayscale level between 0 and 255.

Additionally, as described above, the image data may be dithered using various techniques to improve visual accuracy of the image. In other words, the grayscale levels for each pixel of the display panel 40 may be set to implement the dithering. To help illustrate, examples of dithering techniques that may be utilized by the source dithering component 42 and/or the TCON dithering component 44 are described below. It should be appreciated that the following dithering techniques are only meant to be illustrative and that any other suitable dithering technique may be used by either the source dithering component 42 and/or the TCON dithering component 44.

Figure 6:
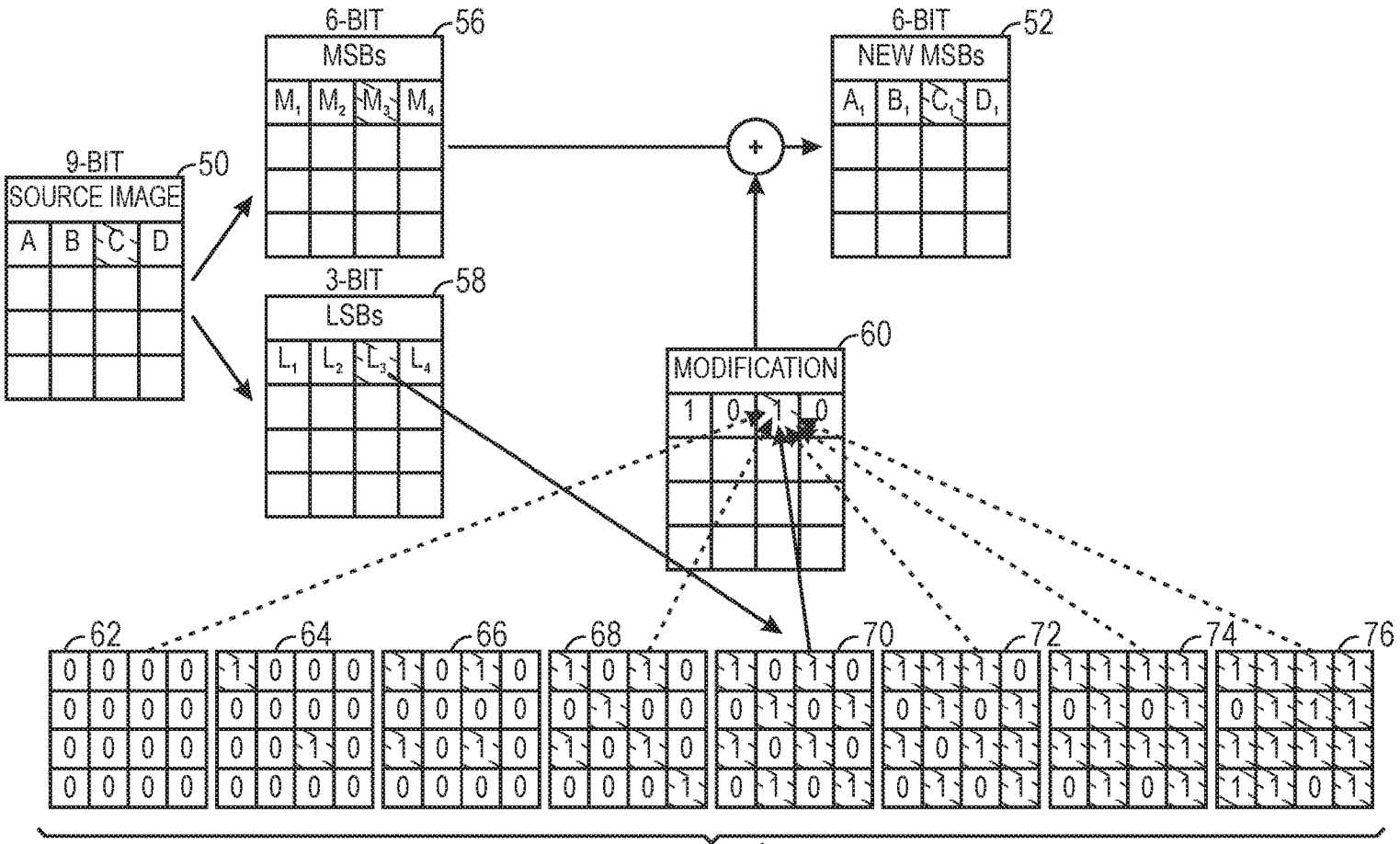
FIG. 6 is an example of a spatial dithering technique that may be used by the computing device of FIG. 1, in accordance with an embodiment.

By way of example, FIG. 6 describes one embodiment of a spatial dithering technique that may be utilized by the source dithering component 42 and/or the TCON dithering component 44. As described above, the image data may be manipulated so as to increase color noise in the displayed image, such that color banding is decreased and sharp edges are less detectable. As such, spatial dithering may improve the image perception and quality. In fact, in some embodiments, spatial dithering may enable a source image 50 to be converted to a dither image 52 with lower pixel depth, for example, through the most significant bit (MSB) and a least significant bit (LSB) process described in FIG. 6.

In some embodiments, to introduce color noise, dithering patterns 54 may be applied to the source image 50. More specifically, applying the dithering patterns 54 may spatially distribute the colors and luminance of the source image 50 so as to enable the display of the source image 50 at a lower pixel depth while significantly preserving the perceived image quality.

In some embodiments, the source image 50 may be decomposed by color channel before applying the dithering patterns 54. For example, a red source image, which describes red grayscale levels for each pixel, a green source image, which describes green grayscale levels for each pixel, and a blue source image, which describes blue grayscale levels for each pixel, may be generated. Additionally, in some embodiments, the source image 50 may be subdivided into multiple source image groups (e.g., windows) corresponding to different areas of the image. In one example, a group is sized as 4×4 pixel group having a total of 16 pixels.

As depicted, the source image 50 may then be used to create a corresponding LSB group 58 and MSB group 56. More specifically, the LSB group 58 and the MSB group 56 may be created by dividing the pixel depth information of each pixel into two values, a LSB value and a MSB value. The LSB values of the pixels in the source image 50 may then be used to create the LSB group 58 and the MSB values of the pixels in the source image 50 may then be used to create the MSB group 56.

More specifically, the pixel's grayscale value may be provided in, or converted to, a binary value, which is then divided into the LSB value and the MSB value. The most significant bits equal to the pixel depth (e.g., 6 bits) of the display 12 are selected as the MSB value and the remainder bits are selected as the LSB value. For example, suppose that the original image is stored at a 9-bit pixel depth and the display 12 is a 6-bit pixel depth display. If the original pixel color channel has a decimal grayscale level of forty-four, the resulting binary number is "000101100." As such, the six most significant bits are "000101" and the three remaining bits are "100." The dither patterns 54 to apply may be selected based on the LSB value and used to create a modification matrix 60, which may be mathematically added (e.g., through matrix addition) to the MSB group 56 to generate the dithered image data 52.

To help illustrate, in the depicted embodiment, the source image data 50 may include values as follows A="010001101," B="110011011," C="000101100," and D="111100000." The most significant bits (e.g., six bits) of the source image grayscale levels A, B, C, and D, may then be used to derive the values M1="010001," M2="110011," M3="000101," M4="111100," of a first row of the MSB group 56. The remaining three bits of the of the source image values A, B, C, D, may then be used to derive the values L1="101," L2="011," L3="100," L="000," of a first row of the LSB group 58.

As described above, the dither patterns 54 (e.g., individual dither patterns 62, 64, 66, 68, 70, 72, 74, and 76) may then be selected and used to create the modification matrix 60 based on the LSB group 58. More specifically, the magnitude or value of the 3-bit binary number stored in each cell of the LSB group 58 may be used to select one of the eight illustrated dither patterns 54. For example, in the depicted embodiment, cell L4 may have the value of "0," which corresponds to the first of eight possible values (e.g., 0 to 7). Accordingly, the first dither pattern 62 may be selected. Similarly, since the cell L3 contains the value "4," the fifth dither pattern 70 may be selected. Additionally, since the cell L2 contains the value "3," the fourth dither pattern 68 may be selected. Furthermore, since the L1 cell contains the value "5," the sixth dither pattern 72 may be selected. In this way, the first row of the LSB group 58 may each map to one of the dither patterns 54. All other cells of the LSB group 58 may be mapped to one of the dither patterns 54 in a similar manner.

Once the dither patterns 54 are selected, the LSB group 58 may be used to select one of the cells in each of the selected dither patterns 54 for use in the modification matrix 60. To make such a selection, the position of each cell in the LSB group 58 is used to identify the same position in the selected dither pattern 54. For example, in the depicted embodiment, L3 may first be used to select the dither pattern 70 and then L3's cell position may be used to select the first row, third column cell in the dither pattern 70. The value in this first row, third column cell (i.e., "1") of the dither pattern 70 may then be used to fill the cell at the same position (i.e., first row, third column) in the modification matrix 60. Similarly, cells L1, L2, and L4 may be used to fill in the first row of the modification matrix 60.

The modification matrix 60 may then be added to the MSB group 56, for example, using matrix addition. That is, each cell in the MSB group 56 may be added to the corresponding cell in the modification matrix 60. The result of the addition operation is the dithered image data 52. For example, using the values in the depicted embodiment, the decimal values for the first row of the dithered image data 52 is A1="17"+"1"="18," B1="51"+"0"="51," C1="5"+"1"="6," and D1="60"+"0"="60." The remaining rows of the dithered image data may be similarly computed.

Figure 7:
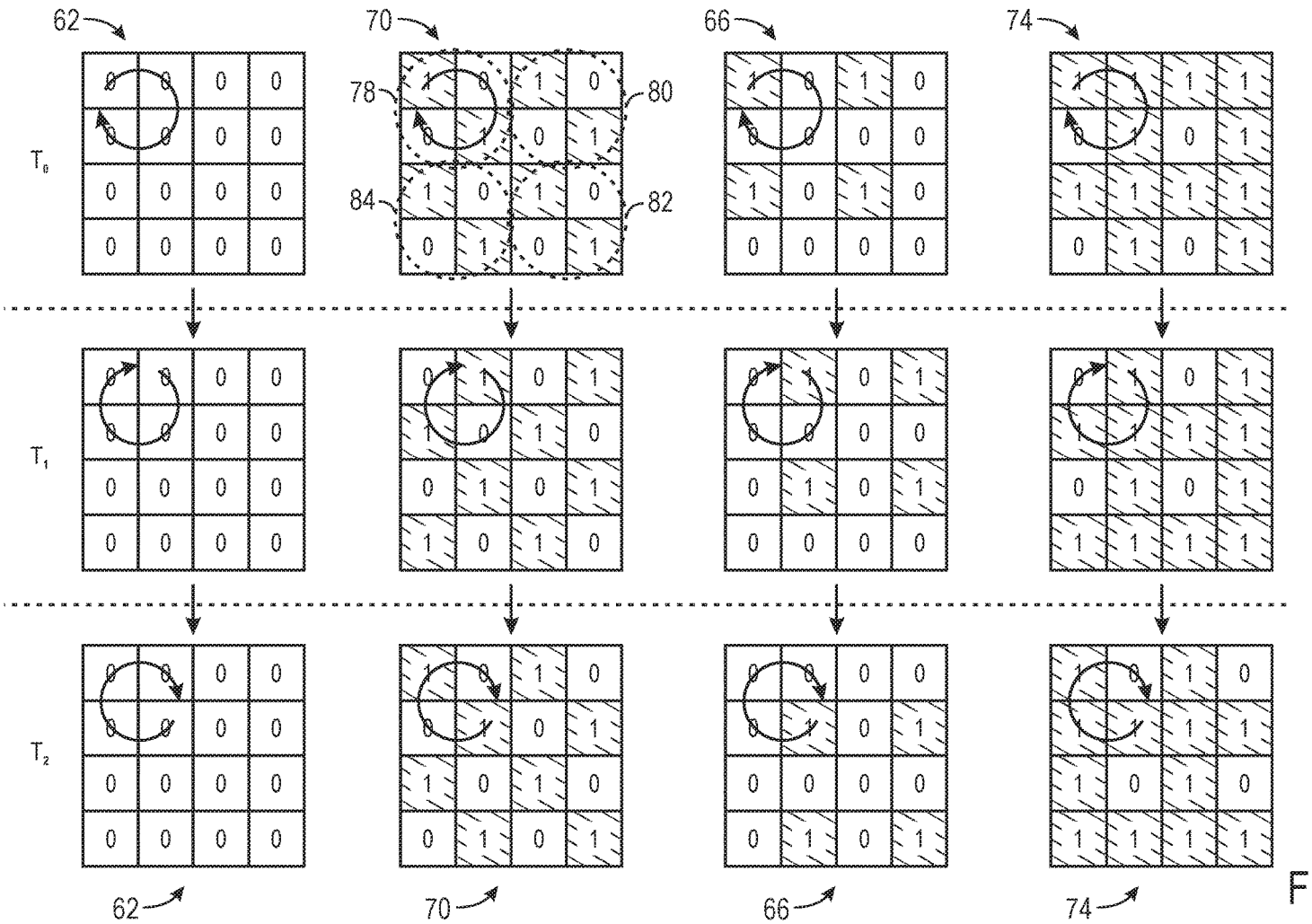
FIG. 7 is an example of a spatio-temporal dithering technique that may be used by the computing device of FIG. 1, in accordance with an embodiment.

By way of further example, FIG. 7 describes one embodiment of a spatio-temporal dithering technique that may be utilized by the source dithering component 42 and/or the TCON dithering component 44. As described above, an image may be temporally dithered such that a viewer's eyes combine successively displayed images. For example, the color of a pixel in a first image may appear to be blended with the color of a pixel in a second image so that the viewer sees an intermediate color.

In some embodiments, temporal dithering techniques may be combined with spatial dithering techniques into a spatio-temporal dithering technique. For example, spatial dithering techniques may be combined with temporal dithering techniques by temporally dithering the spatial dithering patterns 54 as described in FIG. 7. In other words, any of the dither patterns 54 may be temporally dithered and used in addition to the LSB-MSB techniques described above to further improve the viewed accuracy of a displayed image.

By way of example, each row in the depicted embodiment represents a temporal frame at times T0, T1, and T2. More specifically, a first row shows an example of an initial condition (e.g., position of the zero and ones) of the dithering patterns 62, 70, 66, and 74 at T0. In other words, the depicted dithering patterns may be used to generate the modification matrix 60 used to spatially dither at T0.

Similarly, a second row shows a condition of the dithering patterns 62, 70, 66, and 74 at T1. As depicted, the dithering patterns are temporally shifted at T1 from their positions at T0, for example, via a clockwise rotation of the bits. More specifically, in the depicted embodiment, each dithering pattern is divided into groups of four bits. In other words, each dithering pattern may be divided into a top left quadrant 78, a top right quadrant 80, a bottom right quadrant 82, and a bottom left quadrant 84. As such, each quadrant may have the bits rotated in a clockwise direction as depicted. For example, the top row (e.g., top two bits) of the top left quadrant 78 has shifted from storing the bits "1" and "0" at time T0 to storing the bits "0" and "1" at time T1. Additionally, the bottom row (e.g., bottom two bits) of top let quadrant 78 has shifted from storing the bits "0" and "1" at time T0 to storing the bits "1" and "0" at time T1. As described above, the shifted dithering patterns at T1 may then be used to create the modification matrix 60 and spatially dither the image.

Additionally, a third row shows a condition of the dithering patterns 62, 70, 66, and 74 at T2. The dithering patterns may similarly be generated by temporally shifting the dithering patterns at T2, for example, via a clockwise rotation of the bits. Accordingly, as depicted, the top row of the top left quadrant 78 has shifted from storing the bits "0" and "1" at time T1 to storing the bits "1" and "0" at time T2. Additionally, the bottom row of the quadrant 78 has shifted from storing the bits "1" and "0" at time T1 to storing the bits "0" and "1" at time T2. The other quadrants 80, 82, and 84 may similarly be temporally shifted and used to spatially dither the source image data 50. Accordingly, temporally dithering the spatial dithering patterns 54 may enable the display 12 to display image data such that the viewed image is perceived as having a higher visual quality because the human eye may perceive the multiple frames displayed sequentially in time as a single frame having an improved image quality.

However, as the refresh rate is decreased some dithering techniques may actually decrease image quality, for example, by causing flickering. More specifically, in some embodiments, since pixel color may vary between successively displayed images, the variations may be more noticeable and be viewed as flickering. For example, if the refresh rate is reduced to 1 Hz, each image will be displayed for 1 second. At such speeds, a viewer's eye may not combine pixel colors from successively displayed images and instead be able to distinguish between varying pixel colors, which may cause a flicker to appear on the viewed image.

In some embodiments, a flicker may begin be noticeable when the refresh rate is lowered below a threshold refresh rate. As used herein, a "threshold refresh rate" is intended to describe a refresh rate at or below which flickering may be noticed in a displayed image. In some embodiments, the threshold refresh rate may be 35-38 Hz. Additionally in some embodiments, the threshold refresh rate may be adjustable, for example, based on a specific user's tolerance of artifacts, a user's desire to save power, the type of images being displayed, and the like. For instance, in a more conservative approach, the threshold refresh rate may be increased above 38 Hz and, in a more aggressive approach, the threshold refresh rate may be decreased below 35 Hz.

Figure 8:
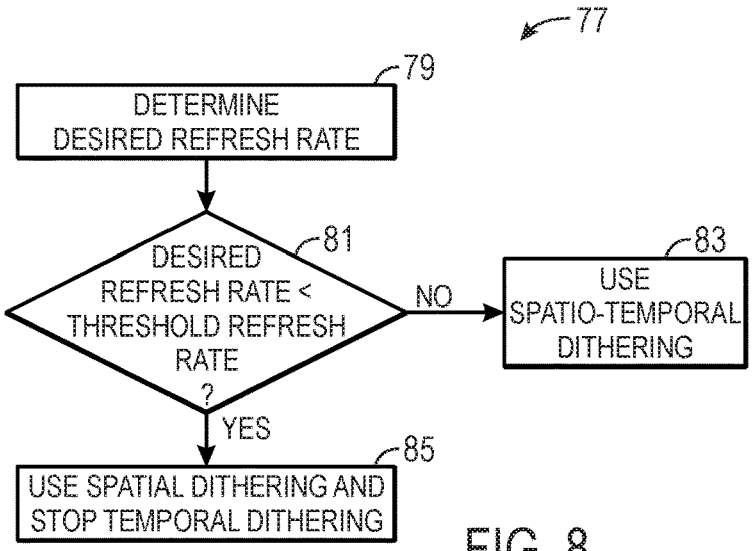
FIG. 8 is a flow diagram of a process for improving image quality of images displayed below a threshold refresh rate, in accordance with an embodiment.

Accordingly, it may desirable to disable temporal dithering when the refresh rate is lowered below a threshold refresh rate. One embodiment of a process 77 for determining when to disable temporal dithering is described in FIG. 8. Generally the process 77 includes determining a desired refresh rate (process block 79), determining whether the desired refresh rate is less than a threshold refresh rate (decision block 81), and, if the desired refresh rate is greater than the threshold refresh rate, using spatio-temporal dithering on the image data (process block 83). On the other hand, if the desired refresh rate is lower than or equal to the threshold refresh rate, the process 77 includes using spatial dithering on the image data and disabling temporal dithering (process block 85). In some embodiments, process 77 may be implemented with instructions stored in memory 48 or another storage device and executed by processor 46.

Accordingly, in some embodiments, the timing controller 38 may determine the desired refresh rate (process block 79). More specifically, in some embodiments, the timing controller 38 may determine the desired refresh rate when a user manually inputs a desired refresh rate, for example, via input structures 14. Additionally or alternatively, the desired refresh rate may be automatically determined by the computing device 10. For example, as described above, the refresh rate of the display 12 may be reduced to decrease power usage by the computing device 10. As such, the computing device 10 may automatically or in response to a user input conserve battery power by automatically determining a desired refresh rate. In any embodiment, the timing controller 38 may receive the desired refresh rate from the processor 18 and/or the image processing circuitry 17.

The timing controller 38 may then determine whether the desired refresh rate is lower than a threshold refresh rate (decision block 81). As can be appreciated, the threshold refresh rate may vary depending on characteristics of the display 12, such as the type of display 12 (e.g., LCD or OLED), the resolution of the display 12, pixel depth of the display 12, and the like. Accordingly, in some embodiments, the threshold refresh rate may previously be determined, for example by the display manufacturer, and stored in the timing controller memory 48. As such, the timing controller 38 may retrieve the threshold refresh rate from memory 48 and compare the desired refresh rate to the threshold refresh rate.

When the desired refresh rate is higher than the threshold refresh rate, the timing controller 38 may perform temporal dithering on received image data because flickering should not be visible (process block 83). For example, in some embodiments, the timing controller 38 may utilize the spatio-temporal dithering technique described above. In other words, more generally, the timing controller 38 may process received image data using any suitable dithering technique including temporal dithering and/or spatio-temporal dithering.

On the other hand, when the desired refresh rate is lower than the threshold refresh rate, the timing controller 38 may cease temporal dithering on received image data because temporal dithering may cause flickering (process block 85). In some embodiments, the timing controller 38 may utilize other dithering techniques on the received image data. For example, the timing controller 38 may spatially dither the received image data. In some embodiments, the timing controller 38 may perform spatial dithering by disabling the temporal portion of the spatio-temporal dither technique described above. In other words, the timing controller 38 may use the same spatial dithering patterns 54 for each time step. In other embodiments, the timing controller 38 may switch to a separate spatial dithering component. For example, the timing controller 38 may switch to an error-diffusion (e.g., spatial) dithering component to process the image data. More specifically, the error-diffusion dithering component may spatially dither the image data and improve viewed image quality by distributing error (e.g., color noise) to surrounding pixels.

Accordingly, quality of an image displayed at a refresh rate below the threshold refresh rate may be improved by ceasing temporal dithering. More specifically, once temporal dithering is ceased, successively displayed images may not contain pixel colors that are intended to be viewed as blended together. As such, the possibility of the image being distorted by flickering may be reduced. In other words, when the refresh rate is reduced from above to below the threshold refresh rate, temporal dithering may be ceased. On the other hand, when the refresh rate is increased from below to above the threshold refresh rate, temporal dithering may resume.

Additionally, even though the refresh rate may be reduced and the temporally dithering may cease, the view image quality may be generally maintained by using other dithering techniques, such as spatial dithering. In fact, in some embodiments, the source 36 may spatially dither the image data using the source dithering component 42 and the timing controller 38 may again spatially dither the image data using the TCON dithering component 44. In such an embodiment, the image data may be successively spatially dithered. However, in some embodiments, the image displayed using image data successively spatially dithered (e.g., by the source dithering component 42 and the TCON dithering component 44) may contain artifacts, which distort image quality.

Figure 9:
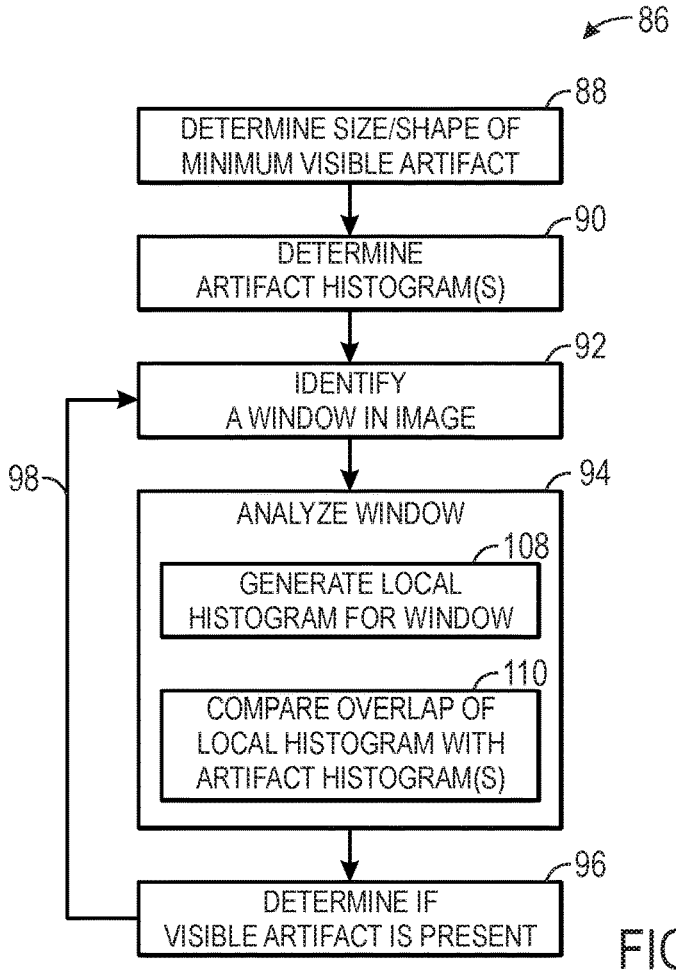
FIG. 9 is a flow diagram of a process for improving image quality of image displayed, in accordance with an embodiment.

As described above, the risk of an image being distorted by artifacts may be reduced by analyzing the image using artifact histograms. As will be described in more detail below, an "artifact histogram" is intended to describe a distribution of pixel grayscale values, which if displayed will contain an artifact. To help illustrate, one embodiment of a process 86 for reducing the risk of artifacts is described in FIG. 9. Generally, the process 86 includes determining size/shape of a minimum visible artifact (process block 88), determining one or more artifact histograms (process block 90), identify a window in an image to be displayed (process block 92), analyzing the window using the one or more artifact histograms (process block 94), determining if a visible artifact is present (process block 96), and identifying another window in the image for analyzing (arrow 98). In some embodiments, process 86 may be implemented using instructions stored on memory 48 and/or other tangible, non-transitory, computer-readable media and executed by processor 46, source 36, or other processing circuitry.

Accordingly, in some embodiments, determining the size/shape of a minimum visible artifact (process block 88) and/or determining one or more artifact histograms (process block 90) may be performed off-line, for example, by a manufacturer of the display 12 or a manufacturer of the source 36. Generally, any suitable techniques for determining the one or more artifact histograms may be used. As described above, an artifact histogram describes a distribution of pixel grayscale values, which when displayed by display 12, may cause artifacts to be perceived by users. To help illustrate, assuming that a display 12 has 6-bit pixel depth (e.g., capable of displaying 64 varying grayscale levels), examples of artifact histograms are described in FIGS. 10 and 11. More specifically, each artifact histogram may describe a grayscale distribution that causes a particular artifact. It is emphasized that the described artifact histograms are merely illustrative and that any number of artifact histograms may be used. In other words, the described artifact histograms are based on the number of pixels at each grayscale level displayable by the display 12; however, in other embodiment, the grayscale levels may be grouped together. For example, artifact histograms may be based on number of pixels at each group of five grayscale levels displayable by the display 12.

Figure 10:
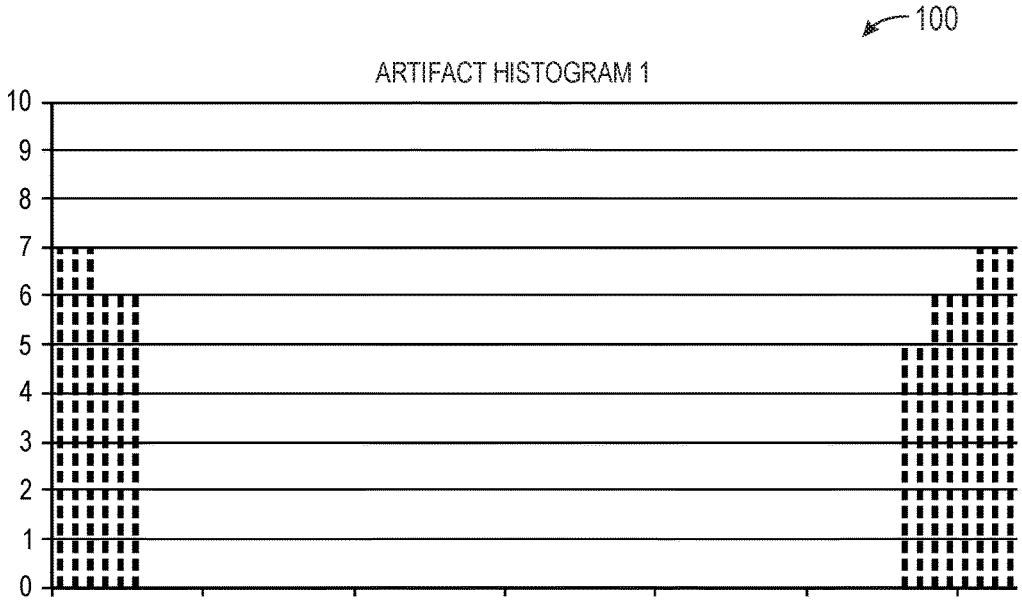
FIG. 10 is an example of a first artifact histogram, in accordance with an embodiment.

A first artifact histogram 100 is described in FIG. 10. As depicted, the first artifact histogram 100 indicates that when pixels in a displayed image have a grayscale distribution as follows, an artifact is likely to be perceived by a viewer.

TABLE 1

Grayscale distribution of Artifact Histogram 1

| Grayscale | No. of Pixels |
|---|---|
| 0 | 7 |
| 1 | 7 |
| 2 | 7 |
| 3 | 6 |
| 4 | 6 |
| 5 | 6 |
| 56 | 5 |
| 57 | 5 |
| 58 | 6 |
| 59 | 6 |
| 60 | 6 |
| 61 | 7 |
| 62 | 7 |
| 63 | 7 |

Figure 11:
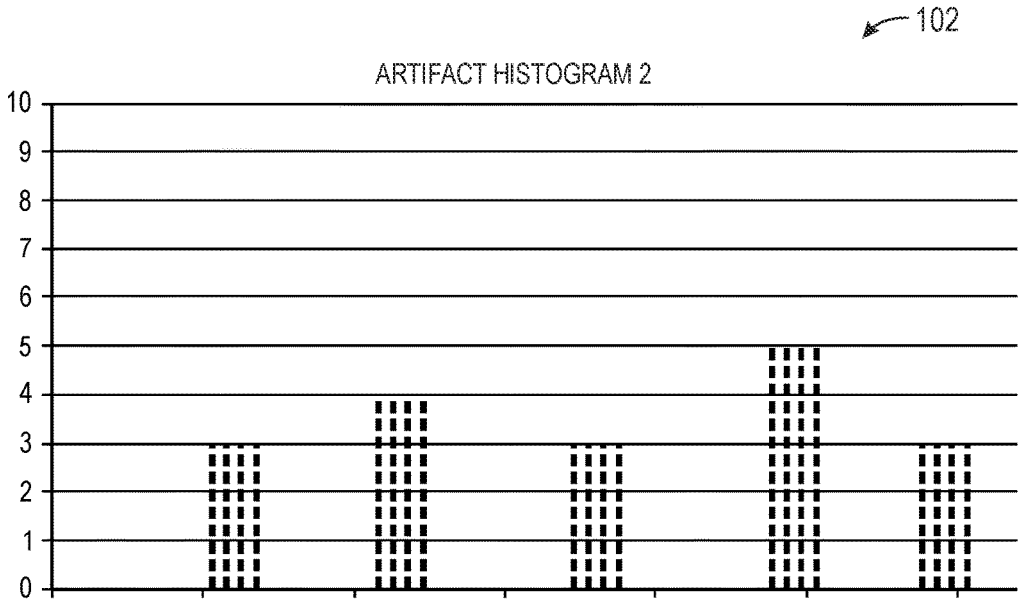
FIG. 11 is an example of a second artifact histogram, in accordance with an embodiment.

Similarly, a second artifact histogram 102 is described in FIG. 11. As depicted, the second artifact histogram 102 indicates that when pixels in a displayed image have a grayscale distribution as follows, an artifact is likely to be perceived by a viewer.

TABLE 2

Grayscale distribution of Artifact Histogram 2

| Grayscale | No. of Pixels |
|---|---|
| 10 | 3 |
| 11 | 3 |
| 12 | 3 |
| 13 | 3 |
| 21 | 4 |
| 22 | 4 |
| 23 | 4 |
| 24 | 4 |
| 34 | 3 |
| 35 | 3 |
| 36 | 3 |
| 37 | 3 |
| 47 | 5 |
| 48 | 5 |
| 49 | 5 |
| 50 | 5 |
| 57 | 3 |
| 58 | 3 |
| 59 | 3 |
| 60 | 3 |

In other words, the closer grayscale distribution in a displayed image is to the first artifact histogram 100 and the second artifact histogram 102, the more likely a perceivable artifact will be displayed. Accordingly, as will be described in more detail below, the artifact histograms 100 and 102 along with any number of additional histograms may be used to determine the likelihood that an artifact will be displayed. It should be noted that although two artifact histograms 100 and 102 are described, any number of artifact histograms may be used.

Additionally, as used herein, the minimum visible artifact describes the smallest artifact that is likely to be perceivable by a user's eye. Generally, any suitable technique for determining the minimum visible artifact may be used. For example, in some embodiments, a display manufacturer may display varying sized artifacts on the display and test the size and/or shape of an artifact when the artifact becomes perceivable to users. As will be described in more detail below, the size/shape of the minimum visible artifact and the one or more artifact histograms may be used online to reduce possibility of artifacts. Accordingly, they may be stored in the timing controller memory 48.

As such, in some embodiments, the timing controller 38 may retrieve the size/shape of the minimum visible artifact and the one or more artifact histograms from memory 48 and use them to reduce possibility of artifacts online, for example, when image data is received from the source 36. More specifically, the timing controller 38 may identify a window (e.g., a portion) of the image to be displayed based at least in part on the size/shape of the minimum visible artifact (process block 92). To help illustrate, an image 104 with windows identified is described in FIG. 12.

As depicted, a first window 106 located in the top left corner of the image 104 is identified. More specifically, the size and/or shape of the first window 106 may be based at least in part on the size and/or shape of the minimum visible artifact. For example, in some embodiments, the first window 106 may be substantially the same size and shape of the minimum visible artifact because it may be assumed that a smaller artifact should not be perceivable. For example, if the minimum visible artifact is a ten pixel by ten pixel square, the first window 106 may also be a ten pixel by ten pixel square. In a more conservative approach, the size and/or shape of the first window 106 may be slightly smaller than the size and/or shape of the minimum visible artifact, for example, an eight pixel by eight pixel square.

Once a window (e.g., first window 106) has been identified, the timing controller 38 may analyze the window for risk of an artifact being displayed in the window. In some embodiments, to determine risk of an artifact, the timing controller 38 may generate a local histogram for the window (process block 108) and compare overlap of the local histogram with the one or more artifact histograms (process block 110). More specifically, the timing controller 38 may generate a local histogram that describes pixel grayscale distribution of the window. In other words, a local histogram may describe the number of pixels in the window at various grayscale levels displayable by the display 12. In some embodiments, a separate local histogram may be generated for each color used by the display 12. For example, a red local histogram, a blue histogram, and a green histogram may be generated. However, to simplify the following discussion, only one local histogram for each window is described.

Figure 13:
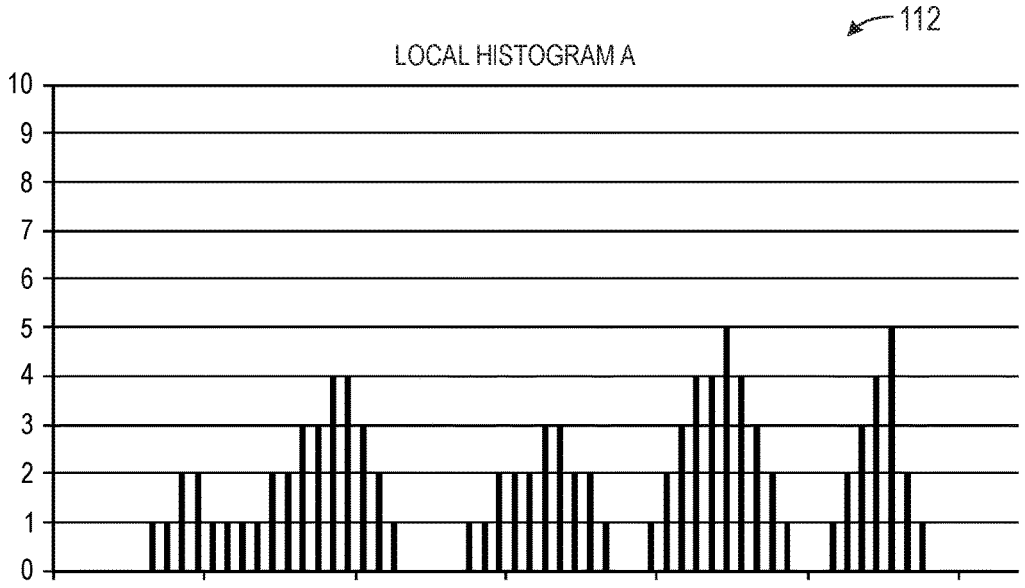
FIG. 13 is an example of a local histogram for a first window identified in the displayed image of FIG. 12, in accordance with an embodiment.

To help illustrate, a first local histogram 112, which describes pixel grayscale distribution of the first window 106, is depicted in FIG. 13. More specifically, the first window 106 may be a ten pixel by ten pixel square.

Accordingly, the first local histogram 112 indicates that the one hundred pixels in the first window 106 have a grayscale distribution as follows.

TABLE 3

| Grayscale distribution of Local Histogram 1 | |
|---|---|
| Grayscale | No. of Pixels |
| 0 | 0 |
| 1 | 0 |
| 2 | 0 |
| 3 | 0 |
| 4 | 0 |
| 5 | 0 |
| 6 | 1 |
| 7 | 1 |
| 8 | 2 |
| 9 | 2 |
| 10 | 1 |
| 11 | 1 |
| 12 | 1 |
| 13 | 1 |
| 14 | 2 |
| 15 | 2 |
| 16 | 3 |
| 17 | 3 |
| 18 | 4 |
| 19 | 4 |
| 20 | 3 |
| 21 | 2 |
| 22 | 1 |
| 23 | 0 |
| 24 | 0 |
| 25 | 0 |
| 26 | 0 |
| 27 | 1 |
| 28 | 1 |
| 29 | 2 |
| 30 | 2 |
| 31 | 2 |
| 32 | 3 |
| 33 | 3 |
| 34 | 2 |
| 35 | 2 |
| 36 | 1 |
| 37 | 0 |
| 38 | 0 |
| 39 | 1 |
| 40 | 2 |
| 41 | 3 |
| 42 | 4 |
| 43 | 4 |
| 44 | 5 |
| 45 | 4 |
| 46 | 3 |
| 47 | 2 |
| 48 | 1 |
| 49 | 0 |
| 50 | 0 |
| 51 | 1 |
| 52 | 2 |
| 53 | 3 |
| 54 | 4 |
| 55 | 5 |
| 56 | 2 |
| 57 | 1 |
| 58 | 0 |
| 59 | 0 |
| 60 | 0 |
| 61 | 0 |
| 62 | 0 |
| 63 | 0 |

The timing controller 38 may then compare the local histogram to the one or more artifact histograms (process block 110). To help illustrate, the first local histogram 112 is compared to the first artifact histogram 100 (dashed) in FIG. 14 and to the second artifact histogram 102 (dashed) in FIG. 15.

Figure 14:
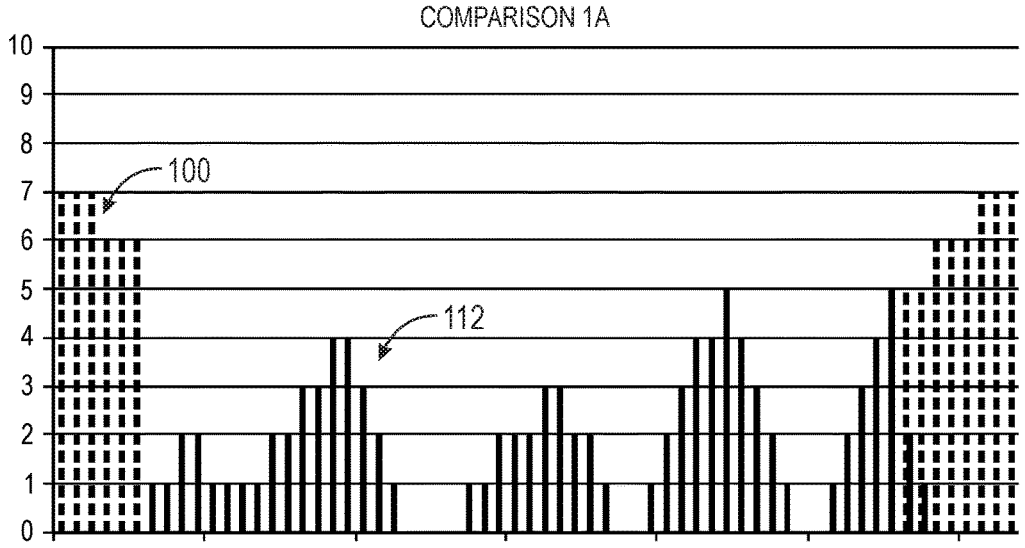
FIG. 14 is a comparison of the first local histogram and the first artifact histogram, in accordance with an embodiment.

More specifically, in comparing the first local histogram 112 and the first artifact histogram 100, the timing controller 38 may determine the amount of overlap between the two. As depicted in FIG. 14, the first local histogram 112 and the first artifact histogram 100 contain some slight overlap. More specifically, two pixels with grayscale level fifty-six overlap with the first artifact histogram 100 and one pixel with grayscale level fifty-seven overlaps with the first artifact histogram 100.

Figure 15:
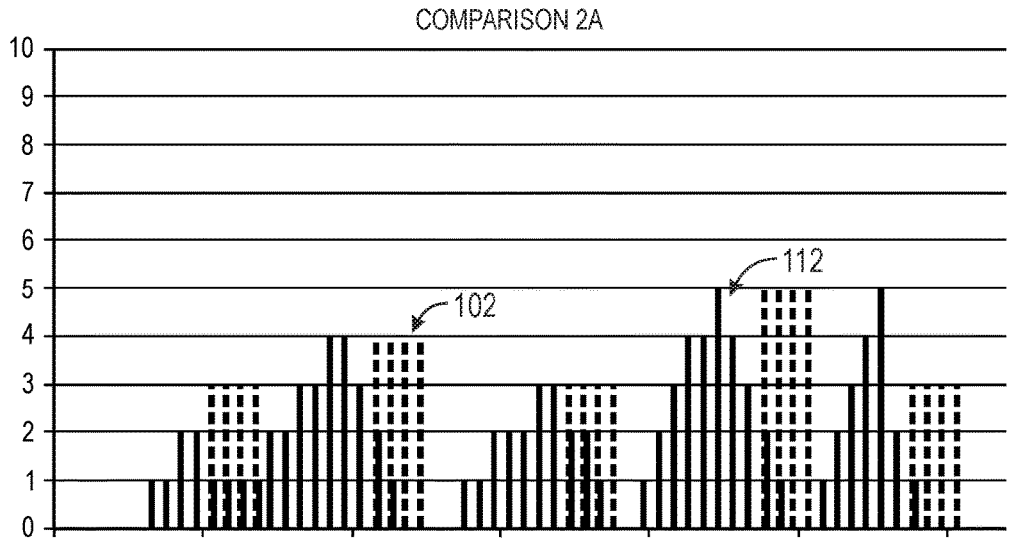
FIG. 15 is a comparison of the first local histogram with the second artifact histogram, in accordance with an embodiment.

Similarly, in comparing the first local histogram 112 and the second artifact histogram 102, the timing controller may determine the amount of overlap between the two. As depicted in FIG. 15, the amount of overlap between the first local histogram 112 and the second artifact histogram 102 is greater. More specifically, one pixel at grayscale level ten, one pixel at grayscale level eleven, one pixel at grayscale level twelve, two pixels at grayscale level twenty-one, one pixel at grayscale level twenty-two, two pixels at grayscale level thirty-four, two pixels at grayscale level thirty-five, one pixel at grayscale level thirty-six, two pixels at grayscale level forty-seven, one pixel at grayscale level forty-eight, and one pixel at grayscale level fifty-seven overlap with the second artifact histogram 102.

As described above, the amount of overlap may indicate the likelihood that a perceivable artifact is displayed. Accordingly, the timing controller 38 may determine whether a perceivable artifact is likely to be displayed based on the amount of overlap between the first local histogram 112 with the first artifact histogram 100 and/or the second artifact histogram 102 (process block 96). Generally, any suitable algorithm for evaluating the amount of overlap may be utilized. For example, in some embodiments, an overlap threshold may be utilized for each artifact histogram and the timing controller 38 may determine that a perceivable artifact will likely be displayed when the overlap threshold for any of the artifact histograms is surpassed. In other words, an overlap threshold may be set such that when the amount of overlap is greater than the overlap threshold a perceivable artifact will likely be displayed.

To help illustrate, in the described embodiment, the overlap threshold for the first artifact histogram 100 may be fifty pixels. In other words, if the amount of overlap is greater than fifty pixels, an artifact is likely to be perceivable. Thus, since the overlap amount is three pixels (e.g., less than overlap threshold), the timing controller 38 may determine that the particular artifact(s) described by the first artifact histogram 100 will not be perceivable when the first window 106 is displayed. Additionally, in the described embodiment, the overlap threshold for the second artifact histogram 102 may be sixty pixels. Thus, since the amount of overlap is sixteen pixels (e.g., less than overlap threshold), the timing controller 38 may determine that the particular artifact(s) described by the second artifact histogram 102 also will not be perceivable when the first window 106 is displayed.

In other embodiments, a combined overlap threshold may be used. In other words, the amount of overlap between a local histogram and each of the artifact histograms may be looked at collectively to determine whether an artifact is likely to be perceivable. More specifically, the amount of overlap between the first local histogram 112 and the first artifact histogram 100 may be added to the amount of overlap between the first local histogram 112 and the second artifact histogram 102, for example, in a weighted or an unweighted manner. For instance, continuing with the above example, the combined overlap of nineteen pixels (e.g., three pixels and sixteen pixels) may be compared with a combined overlap threshold. Accordingly, the timing controller 38 may determine that a perceivable artifact will likely be displayed when the combined overlap threshold is surpassed.

As described above, separate local histograms may be generated for each color utilized by the display 12. Accordingly, in such embodiments, a color based overlap threshold may be utilized. More specifically, the color based overlap threshold may be used in relation to any number of the color based local histograms. For example, the color based overlap threshold may be compared with the amount of overlap between a red local histogram and one or more artifact histograms, a green local histogram and the one or more artifact histograms, and/or a blue local histogram and one or more artifact histograms.

In some such embodiments, a conservative approach may be taken and the maximum amount of overlap between any one of the colored local histograms and the one or more artifact histograms may be compared with the color based overlap threshold. More specifically, when the maximum overlap is less than the color based overlap threshold, the timing controller 38 may determine that a perceivable artifact is not likely to be displayed. In a more aggressive approach, the minimum amount of overlap between any one of the colored local histograms may be compared with the color based overlap threshold. More specifically, when the minimum overlap is less than the color based overlap threshold, the timing controller 38 may determine that the risk of displaying a perceivable artifact is acceptably small.

Figure 12:
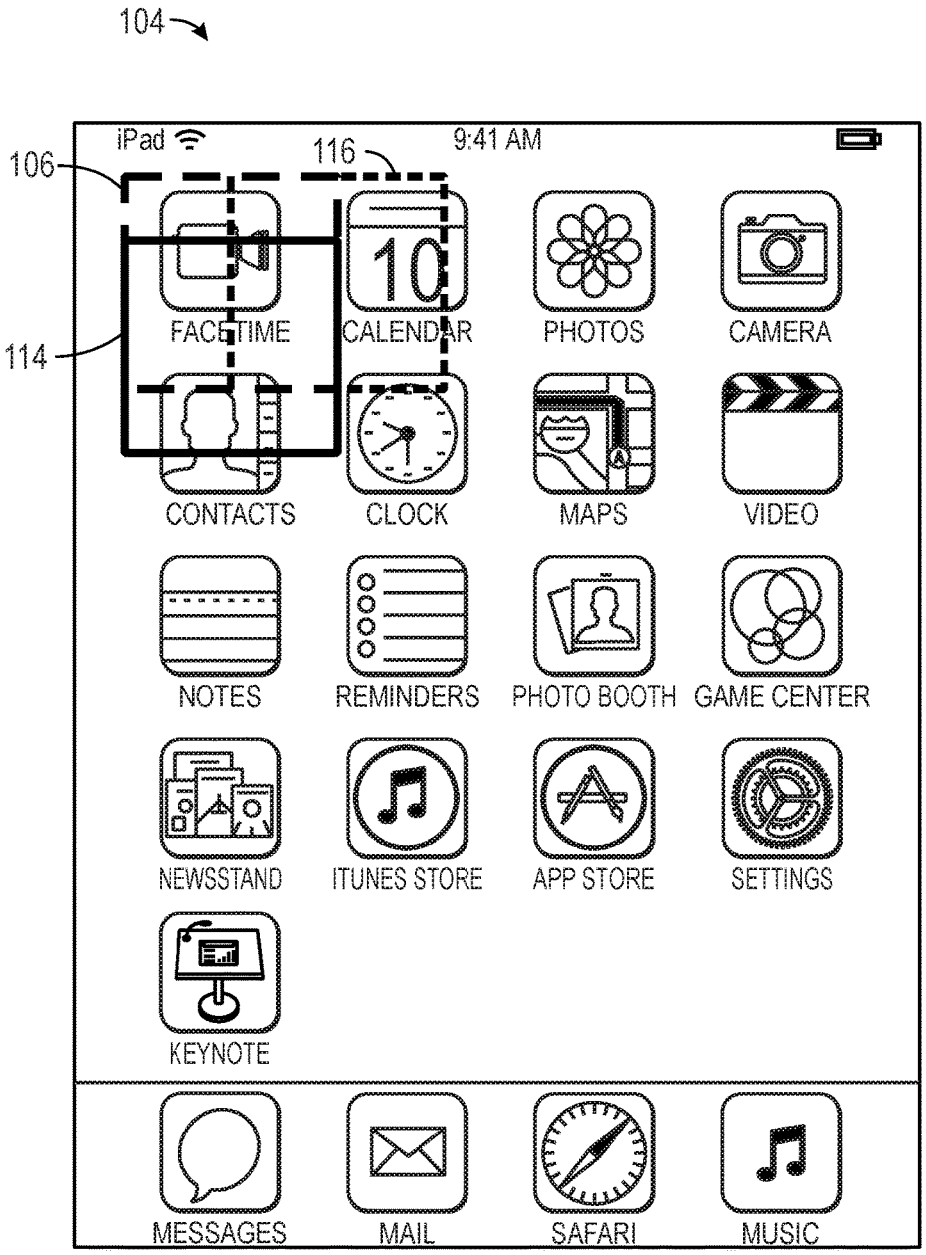
FIG. 12 is a displayed image subdivided into windows, in accordance with an embodiment.

Using any of suitable technique, if the timing controller 38 determines that it is not likely that a perceivable artifact will be displayed in the first window 106, the timing controller 38 may identify a second window 114 as described in FIG. 12. As depicted, the first window 106 and the second window 114 partially overlap. In some embodiments, the first window 106 and the second window 114 may partially overlap because it is possible that a perceivable artifact is not fully contained within the first window 106 and thus the overlap threshold is not reached. However, the perceivable artifact may be more fully contained in the second window 114 and thus surpass the overlap threshold and be detected.

Accordingly, the identification of each window, including the amount of overlap between multiple windows, may be based at least in part on the acceptability of artifacts. For example on either extreme, if no perceivable artifacts are tolerable, the timing controller 38 may merely shift the second window 114 one pixel in relation to the first window 106. On the other extreme, if a few artifacts are tolerable, the timing controller 38 may shift the second window 114 such that there is no overlap with the first window 106. As can be appreciated, the number of windows analyzed may also affect processing requirements, power usage, and heat generated by the timing controller 38. In other words, the location of each window may be based on balancing such factors.

Figure 16:
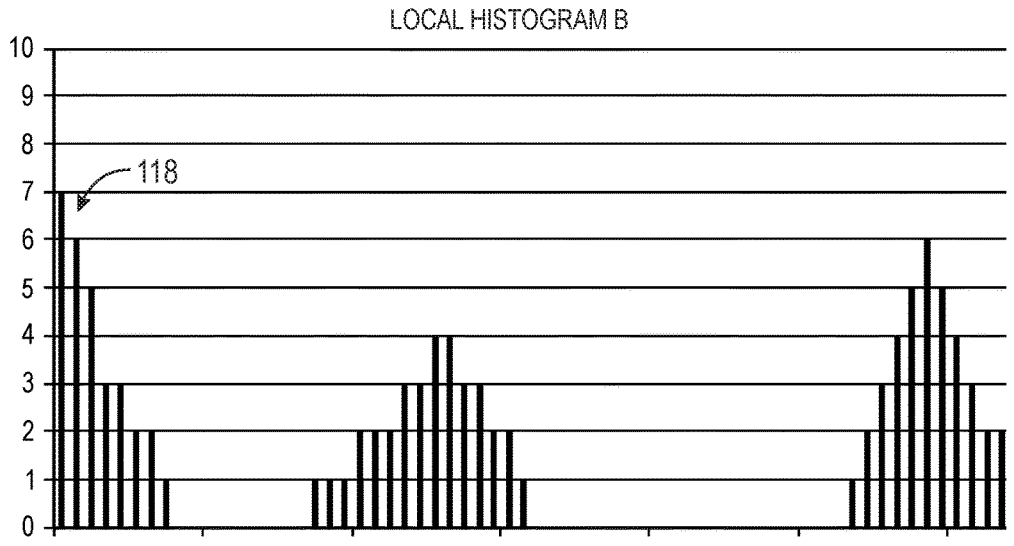
FIG. 16 is an example of a local histogram for a second window identified in the displayed image of FIG. 12, in accordance with an embodiment.

As with the first window 106, the second window 114 may then be analyzed by the timing controller 38 to determine risk of an artifact being displayed in the window. As described above, the timing controller 38 may generate a local histogram for the second window 114 and compare overlap of the local histogram with the one or more artifact histograms. More specifically, the timing controller 38 may generate a second local histogram 118 that describes pixel grayscale distribution of the second window 114 as depicted in FIG. 16. In other words, the second local histogram 118 indicates that the one hundred pixels in the second window 114 have a grayscale distribution as follows.

TABLE 4

Grayscale distribution of Local Histogram 2

| Grayscale | No. of Pixels |
|---|---|
| 0 | 7 |
| 1 | 6 |
| 2 | 5 |
| 3 | 3 |
| 4 | 3 |
| 5 | 2 |
| 6 | 2 |
| 7 | 1 |
| 8 | 0 |
| 9 | 0 |
| 10 | 0 |
| 11 | 0 |
| 12 | 0 |
| 13 | 0 |
| 14 | 0 |
| 15 | 0 |
| 16 | 0 |
| 17 | 1 |
| 18 | 1 |
| 19 | 1 |
| 20 | 2 |
| 21 | 2 |
| 22 | 2 |
| 23 | 3 |
| 24 | 3 |
| 25 | 4 |
| 26 | 4 |
| 27 | 3 |
| 28 | 3 |
| 29 | 2 |
| 30 | 2 |
| 31 | 1 |
| 32 | 0 |
| 33 | 0 |
| 34 | 0 |
| 35 | 0 |
| 36 | 0 |
| 37 | 0 |
| 38 | 0 |
| 39 | 0 |
| 40 | 0 |
| 41 | 0 |
| 42 | 0 |
| 43 | 0 |
| 44 | 0 |
| 45 | 0 |
| 46 | 0 |
| 47 | 0 |
| 48 | 0 |
| 49 | 0 |
| 50 | 0 |
| 51 | 0 |
| 52 | 0 |
| 53 | 1 |
| 54 | 2 |
| 55 | 3 |
| 56 | 4 |
| 57 | 5 |
| 58 | 6 |
| 59 | 5 |
| 60 | 4 |
| 61 | 3 |
| 62 | 2 |
| 63 | 2 |

Figure 17:
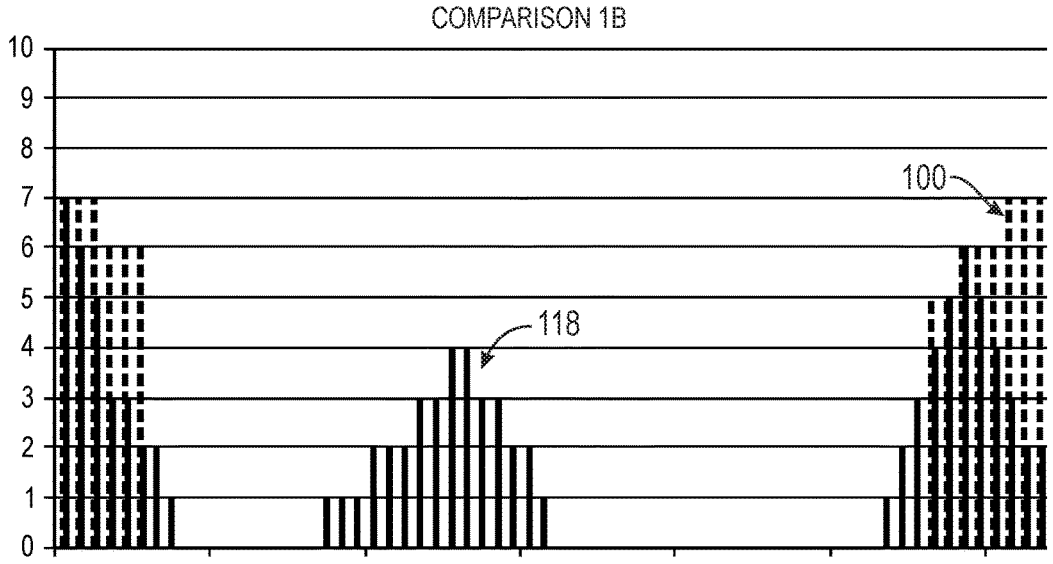
FIG. 17 is a comparison of the second local histogram with the first artifact histogram, in accordance with an embodiment.

The timing controller 38 may then compare the second local histogram 118 to the first artifact histogram 100 (dashed) and determine the amount of overlap as described in FIG. 17. More specifically, in the depicted embodiment, the timing controller 38 may determine that fifty-seven pixels from the second local histogram 118 overlap with the first artifact histogram 100. Based on the amount of overlap, the timing controller 38 may determine whether it is likely that a perceivable artifact will be displayed in window 114. For example, assuming that the overlap threshold for the first artifact histogram 100 is fifty pixels, the timing controller may determine that an artifact is likely to be perceivable when the second window 114 is displayed.

In some embodiments, when the timing controller 38 determines that one of the windows of an image is likely to be displayed with a visible artifact, the display 12 may display the image at a refresh rate above the threshold refresh rate. In other words, the timing controller 38 may utilized the amount of overlap between a local histogram and one or more artifact histograms to determine the refresh rate at which to display an image.

Figure 18:
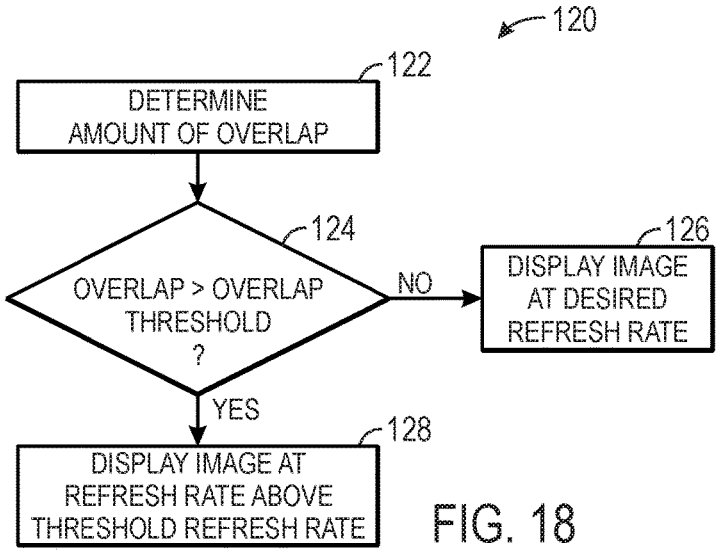
FIG. 18 is a flow diagram of a process for determining refresh rate for a displayed image, in accordance with an embodiment.

To help illustrate, one embodiment of a process 120 for determining the refresh rate is described in FIG. 18. Generally, the process 120 includes determining the amount of overlap (process block 122), determining whether the amount of overlap is greater than an overlap threshold (decision block 124), and, when the amount of overlap is not greater than the overlap threshold, displaying an image at the desired refresh rate (process block 126). On the other hand, when the amount of overlap is greater than the overlap threshold, the process 120 includes displaying the image at a refresh rate above the threshold refresh rate (process block 128). In some embodiments, process 120 may be implemented using instructions stored on memory 48 and/or other tangible, non-transitory, computer-readable media and executed by processor 46, source 36, or other processing circuitry.

Accordingly, in some embodiments, the timing controller 38 may determine the amount of overlap between a local histogram and one or more artifact histograms (process block 122). More specifically, the amount of overlap may be determined using the techniques described above. In other words, in some embodiments, the timing controller 38 may determine the amount of overlap between the local histogram and each of the one or more artifact histograms. Additionally, in some embodiment, the timing controller 38 may determine the combined amount of overlap between the local histogram and the one or more artifacts.

The timing controller 38 may then compare the determined amount of overlap with an overlap threshold (decision block 124). As described above, the amount of overlap may be compared with the overlap threshold to determine whether a perceivable artifact is likely to be displayed. Additionally, as described above, various suitable techniques may be utilized to compare the amount of overlap and the overlap threshold. For example, the amount of overlap between the local histogram and an artifact histogram may be compared with an overlap threshold for the artifact histogram. Additionally or alternatively, the combined amount of overlap between the local histogram and the one or more artifacts may be compared with a combined overlap threshold, for example, in a weighted or unweighted manner. Furthermore, a color specific local histogram may be compared with a color based overlap threshold.

Using any of the various suitable techniques, when the timing controller 38 determines that the amount of overlap is not greater than the overlap threshold, the timing controller 38 may instruct the display 12 to display an image at the desired refresh rate (process block 126). More specifically, the image may be displayed at the desired refresh rate, which may be less than the threshold refresh rate, because the timing controller 38 has determined that the displayed image will not likely contain perceivable artifacts. In fact, in some embodiments, the display 12 may display the image at a refresh rate above the threshold refresh rate even before the amount of overlap is determined and reduce the refresh rate when if it is determined that artifacts will not be present to reduce power usage by the display 12.

On the other hand, when the timing controller 38 determines that the amount of overlap is greater than the overlap threshold, the timing controller 38 may instruct the display 12 to display an image at a specific refresh rate above the threshold refresh rate (process block 128). In some embodiments, the specific refresh rate may be previously determined, for example by a manufacturer of the display 12, and stored in memory 48. More specifically, as described above, when the image is displayed at a refresh rate above the threshold refresh rate, temporal dithering techniques may be utilized on the image data. As such, the possibility of artifacts caused by having two successive spatial dithering components may be reduced.

Accordingly, the technical effects of the present disclosure include improving image quality displayed by an electronic display particularly when the electronic display uses a lower refresh rate (e.g., less than a threshold refresh rate). More specifically, in some embodiments, the likelihood that flickering is perceivable may be reduced by disabling a temporal dither used on image data. Additionally, in some embodiments, the likelihood that an artifact is perceivable may be determined by comparing local histograms, which describe grayscale distribution in at least a portion of an image to be displayed, with one or more artifact histograms, which describe grayscale distribution that will cause an artifact when displayed. More specifically, the amount of overlap may be used to determine the likelihood a perceivable artifact will be displayed, which may then be used to determine a refresh rate at which to display the image.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A computing device, comprising:

an image source configured to generate spatially dithered image data corresponding to an image frame; and a controller communicatively coupled to the image source, wherein the controller is configured to:

determine a first window in the image frame corresponding to a first portion of the spatially dithered image data;

determine a first local histogram based at least in part on the first portion of the spatially dithered image data, wherein the first local histogram is configured to indicate a first grayscale distribution in the first window;

determine a refresh rate with which to display the image frame based at least in part on a first overlap between the first local histogram and a first artifact histogram, wherein the first artifact histogram is configured to indicate a second grayscale distribution expected to cause perceivable artifacts; and instruct an electronic display to display the image frame using the refresh rate.

2. The computing device of claim 1, wherein the controller is configured to:

generate dithered image data based at least in part on the refresh rate at least in part by:

spatially dithering the spatially dithered image data; and temporally dithering the spatially dithered image data when the refresh rate is greater than a threshold refresh rate; and instruct the electronic display to display the image frame based at least in part on the dithered image data.

3. The computing device of claim 1, wherein the controller is configured to:

set the refresh rate at a first refresh rate when the first overlap is greater than an overlap threshold, wherein the first refresh rate is greater than a threshold refresh rate of the electronic display; and set the refresh rate at a second refresh rate when the first overlap is not greater than the overlap threshold, wherein the second refresh rate comprises a desired refresh rate of the image frame less than the threshold refresh rate.

4. The computing device of claim 1, wherein:

the first local histogram is configured to indicate the first grayscale distribution of a first color component in the first window;

the first artifact histogram is configured to indicate the second grayscale distribution of the first color component expected to cause the perceivable artifacts; and the controller is configured to:

determine a second local histogram based at least in part on the first portion of the spatially dithered image data, wherein the second local histogram is configured to indicate a third grayscale distribution of a second color component in the first window; and determine the refresh rate based at least in part on the first overlap and a second overlap between the second local histogram and a second artifact histogram, wherein the second artifact histogram is configured to indicate a fourth grayscale distribution of the second color component expected to cause the perceivable artifacts.

5. The computing device of claim 1, wherein the controller is configured to:

determine a second window in the image frame corresponding to a second portion of the spatially dithered image data;

determine a second local histogram based at least in part on the second portion of the spatially dithered image data, wherein the second local histogram is configured to indicate a third grayscale distribution in the second window; and determine the refresh rate based at least in part on the first overlap and a second overlap between the second local histogram and the first artifact histogram.

6. The computing device of claim 1, wherein the controller is configured to determine the refresh rate based at least in part on the first overlap and a second overlap between the first local histogram and a second artifact histogram, wherein the second artifact histogram is configured to indicate a third grayscale distribution expected to cause the perceivable visual artifacts.

7. The computing device of claim 1, wherein the controller is configured to determine the first window based at least in part on expected size, expected location, or both of the perceivable artifacts.

8. The computing device of claim 1, wherein the first local histogram is configured to indicate number of pixels in the first window at each grayscale level displayable by the electronic display.

9. The computing device of claim 1, wherein the computing device comprises a handheld computing device, a table computing device, or a notebook computer.

10. A method for controlling operation of an electronic display, comprising:

receiving, using a timing controller, image data to be used to display an image frame on the electronic display from an image source;

determining, using the timing controller, a desired refresh rate with which to display the image frame;

determining, using the timing controller, a first local histogram corresponding to a first pixel group in the image frame based at least in part on the image data;

determining, using the timing controller, a first artifact histogram corresponding to a first type of visual artifact;

determining, using the timing controller, a first pixel overlap between the first local histogram and the first artifact histogram;

instructing, using the timing controller, the electronic display to display the image frame at the desired refresh rate when the first pixel overlap is not greater than a first overlap threshold; and instructing, using the timing controller, the electronic display to display the image frame at a different refresh rate when the first pixel overlap is greater than the first overlap threshold, wherein the different refresh rate is greater than the desired refresh rate.

11. The method of claim 10, comprising:

dithering, using the timing controller, the image data to generate dithered image data, wherein the image data comprises spatially dithered image data and dithering the image data comprises:

spatially dithering the image data; and temporally dithering the image data when the image frame is to be displayed using the different refresh rate; and instructing, using the timing controller, the electronic display to display the image frame based at least in part on the dithered image data.

12. The method of claim 10, comprising:

determining, using the timing controller, an expected size of the first type of visual artifact;

determining, using the timing controller, an expected shape of the first type of visual artifact; and selecting, using the timing controller, the first pixel group from the image frame based at least in part on the expected size and the expected shape of the first type of visual artifact.

13. The method of claim 10, comprising:

determining, using the timing controller, a second local histogram corresponding to a second pixel group in the image frame based at least in part on the image data;

determining, using the timing controller, a second pixel overlap between the second local histogram and the first artifact histogram; and instructing, using the timing controller, the electronic display to display the image frame at the desired refresh rate when the second pixel overlap is not greater than the first overlap threshold and the first pixel overlap is not greater than the first overlap threshold.

14. The method of claim 10, comprising:

determining, using the timing controller, a second local histogram corresponding to the first pixel group based at least in part on a first color component of the image data, wherein the first local histogram is determined based at least in part on a second color component of the image data;

determining, using the timing controller, a second artifact histogram corresponding to a second type of visual artifact expected to result from grayscale distribution of the first color component, wherein the first type of visual artifact results is expected to result from grayscale distribution of the second color component;

determining, using the timing controller, a second pixel overlap between the second local histogram and the second artifact histogram; and instructing, using the timing controller, the electronic display to display the image frame at the desired refresh rate when:

the first pixel overlap is not greater than the first overlap threshold and the second pixel overlap is not greater than a second overlap threshold, wherein the second overlap threshold is different from the first overlap threshold;

a sum of the first pixel overlap and the second pixel overlap is not greater than a total overlap threshold; or both.

15. The method of claim 10, wherein determining the first local histogram comprises determining number of pixels in the first pixel group at different grayscale levels displayable by the electronic display.

16. A tangible, non-transitory, computer-readable medium configured to store instructions executable by one or more processors in a computing device, wherein the instructions comprise instructions to:

select, using the one or more processors, a first pixel group from an image frame to be displayed on an electronic display;

determine, using the one or more processors, whether a perceivable visual artifact is expected to occur in the first pixel group when the image frame is displayed based at least in part on a first overlap between a first grayscale distribution of the first pixel group and a first plurality of grayscale distributions expected to result in the perceivable visual artifact occurring;

adjust, using the one or more processors, a refresh rate with which to display the image frame based at least in part on whether the perceivable visual artifact is expected to occur in the first pixel group; and instruct, using the one or more processors, the electronic display to display the image frame at the refresh rate.

17. The computer-readable medium of claim 16, comprising instructions to:

determine, using the one or more processors, the first grayscale distribution to indicate grayscale distribution of a red color component in the first pixel group;

determine, using the one or more processors, a second grayscale distribution to indicate grayscale distribution of a blue color component in the first pixel group; and determine, using the one or more processors, a third grayscale distribution to indicate grayscale distribution of a green color component in the first pixel group;

wherein the instructions to determine whether the perceivable visual artifact is expected to occur in the first pixel group comprise instructions to:

determine whether the perceivable visual artifact is expected to occur based at least in part on a second overlap between the second grayscale distribution and a second plurality of grayscale distributions expected to result in the perceivable visual artifact occurring;

determine whether the perceivable visual artifact is expected to occur based at least in part on a third overlap between the third grayscale distribution and a third plurality of grayscale distributions expected to result in the perceivable visual artifact occurring; and determine whether the perceivable visual artifact is expected to occur based at least in on a sum of the first overlap, the second overlap, and the third overlap.

18. The computer-readable medium of claim 17, wherein the instructions to determine whether the perceivable visual artifact is expected to occur in the first pixel group comprise instructions to:

determine that the perceivable visual artifact is expected to occur when the first overlap is greater than a first overlap threshold;

determine that the perceivable visual artifact is expected to occur when the second overlap is greater than a second overlap threshold;

determine that the perceivable visual artifact is expected to occur when the third overlap is greater than a third overlap threshold; and determine that the perceivable visual artifact is expected to occur when the sum of the first overlap, the second overlap, and the third overlap is greater than a combined overlap threshold.

19. The computer-readable medium of claim 16, comprising instructions to:

select, using the one or more processors, a second pixel group from the image frame, wherein the second pixel group partially overlaps with the first pixel group;

determine, using the one or more processors, whether the perceivable visual artifact is expected to occur in the second pixel group when the image frame is displayed based at least in part on a second overlap between a second grayscale distribution of the second pixel group and the first plurality of grayscale distributions; and adjust, using the one or more processors, the refresh rate based at least in part on whether the perceivable visual artifact is expected to occur in the second pixel group.

20. The computer-readable medium of claim 16, wherein the instructions to adjust the refresh rate comprise instructions to:

increase the refresh rate above a threshold refresh rate of the electronic display when the perceivable visual artifact is expected to occur in the first pixel group; and decrease the refresh rate below the threshold refresh rate when the perceivable visual artifact is not expected to occur in the first pixel group or any other pixel groups in the image frame.

* * * * *